United States Patent [19]

Ishida et al.

[11] 4,080,914

[45] Mar. 28, 1978

[54] SEWING MACHINE WITH IMPROVED NON-RAVEL SEAMING CONTROLLER

[75] Inventors: Giichi Ishida; Masayoshi Sunada, both of Hitachi, Japan

[73] Assignee: Hitachi, Ltd., Japan

[21] Appl. No.: 725,631

[22] Filed: Sep. 22, 1976

[30] Foreign Application Priority Data

Sep. 23, 1975 Japan ..... 50-115030

[51] Int. Cl.[2] ..... D05B 69/18; D05B 69/20

[52] U.S. Cl. ..... 112/277; 112/300; 112/210

[58] Field of Search ..... 112/219 A, 203, 210, 112/121.11, 252, 220, 271, 277, 300

[56] References Cited

U.S. PATENT DOCUMENTS

| | | | |
|---|---|---|---|
| 3,074,632 | 1/1963 | Braun et al. | 112/121.11 X |
| 3,688,714 | 9/1972 | Makihara et al. | 112/210 X |
| 3,761,790 | 9/1973 | Daab | 112/219 A X |
| 3,827,381 | 8/1974 | Baanstra et al. | 112/210 X |
| 3,977,338 | 8/1976 | Wurst et al. | 112/210 |

*Primary Examiner*—Werner H. Schroeder
*Assistant Examiner*—Peter Nerbun
*Attorney, Agent, or Firm*—Craig & Antonelli

[57] ABSTRACT

In a control circuit for controlling the rotating speed of a clutch and brake motor of a sewing machine capable of performing non-ravel seaming, an improved non-ravel seaming controller for enabling non-ravel seaming during a certain number of seams at the start of sewing and for generating a medium speed signal at a predetermined level during a certain number of seams at the end of sewing to enable non-ravel seaming at such time.

15 Claims, 4 Drawing Figures

SEWING MACHINE WITH IMPROVED NON-RAVEL SEAMING CONTROLLER

BACKGROUND OF THE INVENTION

The present invention relates to a control circuit for industrial sewing machines including a non-ravel seaming mechanism.

The conventional sewing machines including an automatic non-ravel seaming mechanism have been improved. In one of those, at the start of sewing the rotating speed of a clutch and brake motor is kept at medium speed to actuate a work feed reversing mechanism to carry out non-ravel seaming up to the desired point, and at the end of the sewing operation, the speed of the clutch and brake motor is again decreased down to the predetermined low speed over a certain period. After that, the speed of the clutch and brake motor is increased again up to medium speed to actuate the work feed reversing mechanism.

The above-mentioned sewing machine has the drawback that the time required for the non-ravel seaming is relatively long, for example, 1360 ms is required. The drawback results from the fact that the speed of the clutch and brake motor is decreased down to low speed at the end of sewing.

SUMMARY OF THE INVENTION

An object of the present invention is to provide a control circuit for a sewing machine capable of performing an automatic non-ravel seaming at high speed and without the slowdown of the speed of the clutch and brake motor at the end of the sewing.

Another object of this invention is to provide a digital control circuit for a sewing machine capable of performing automatic non-ravel seaming, which operates with high reliability.

These objects above mentioned have been attained by the control circuit for controlling the rotating speed of a clutch and brake motor of a sewing machine capable of performing non-ravel seaming at the start and end of sewing comprising a start switch for generating a start signal, an actual speed signal generator of a main shaft of said sewing machine, a needle position detector for generating a needle position signal, a speed signal generator for generating a desired speed signal, a thread cutting switch for generating a thread cutting signal, a speed controller for controlling said clutch and brake motor by comparing the speed signal from said speed signal generator and the actual speed signal from said actual speed signal generator, and a non-ravel seaming controller which comprises first means for clamping the speed signal from said speed signal generator to said speed controller under a predetermined level during a certain duration when the start signal from said start switch is received, and second means for generating a medium speed signal under the predetermined level to said speed controller during the certain duration when the thread cutting signal from said thread cutting switch is received.

DETAILED DESCRIPTION OF THE INVENTION

Figure 1:
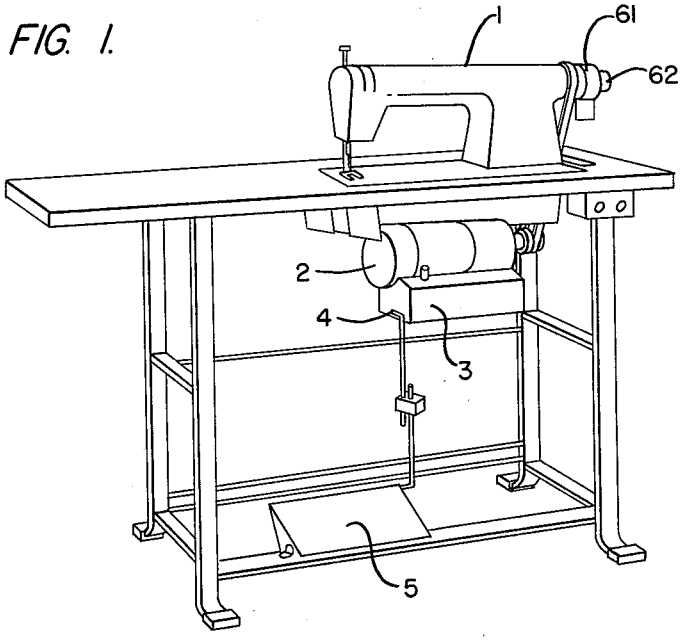
FIG. 1 is a perspective view of a sewing machine to which the present invention is applied.
Figure 2:
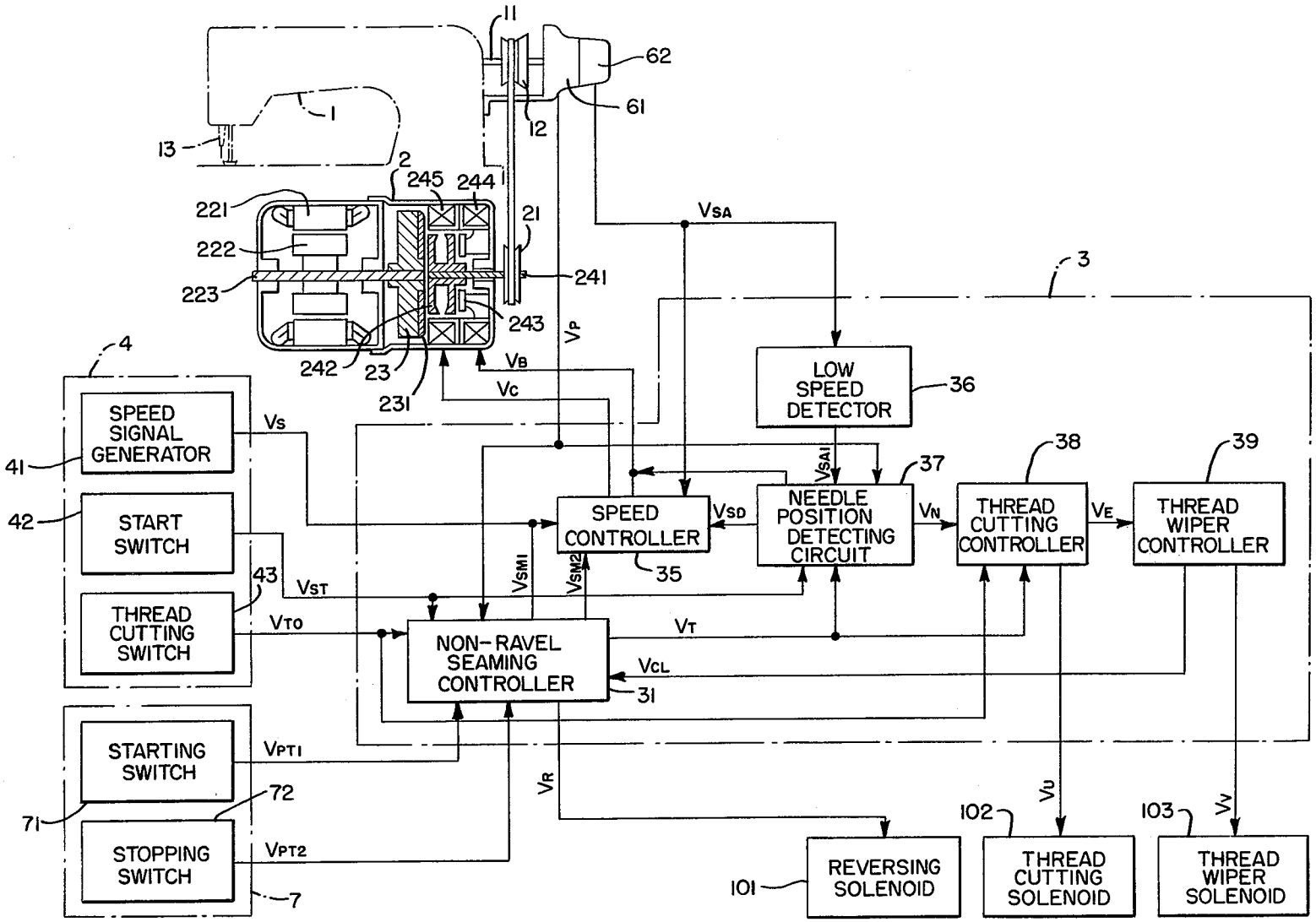
FIG. 2 is a schematic block diagram of a digital controller for said sewing machine.

Referring now to FIGS. 1 and 2, there is shown a sewing machine 1 which has its main shaft 11 mechanically connected to a reciprocable needle 13. A pulley 12 is rigidly fixed to the main shaft 11. To one end of the main shaft 11 a needle position detector 61 and a tacho-generator 62 are mechanically connected. The needle position detector 61, which is well known in the art, generates a pulse signal $V_p$ when the reciprocable needle 13 is found at the lowest position of its cyclic operation. This tacho-generator 62 generates a signal $V_{SA}$ indicating the actual rotating speed of the main shaft 11.

A clutch and brake motor 2 is provided for generating the torque transmitted to the main shaft 11 of the sewing machine 1. A pulley 21 is rigidly mounted on the outer end of a movable shaft 241 of the clutch and brake motor 2, and a belt 14 is mounted between the pulleys 12 and 21. The clutch and brake motor 2 has an induction motor 22 consisting of a stator 221 and a rotor 222 which is rigidly connected to a rotary shaft 223. To the inner end of the rotary shaft 223 a flywheel 23 is fixed which has a friction plate 231 mounted on one surface thereof. A brake friction plate 243 is fixed on the stationary portion or casing. A clutch disk 242 which is rigidly mounted on the movable shaft 241 is interposed between the clutch friction plate 231 and the brake friction plate 243. A clutch coil 245 and a brake coil 244 are disposed around the clutch disk 242 within the housing of the clutch and brake motor 2. The clutch coil 245 and the brake coil 244 are supplied with corresponding signals $V_C$ and $V_B$ from a digital controller 3, respectively.

The digital controller 3 has a pedal sensor 4 associated therewith which comprises a speed signal generator 41, a start switch 42 and a thread cutting switch 43. The pedal sensor 4 is controlled by a foot pedal 5. The speed signal generator 41 generates a voltage signal $V_S$ depending on the amount of the depression of the foot pedal 5. The start switch 42 generates a signal $V_{ST}$ when the foot pedal 5 is depressed forward. The thread cutting switch 43 generates a voltage $V_{TO}$ when the foot pedal 5 is depressed backward. The signals, $V_S$, $V_{ST}$ and $V_{TO}$ are fed to the digital controller 3.

A non-ravel seaming switch 7 comprises a starting switch 71 and a stopping switch 72. The starting switch generates a signal $V_{PT1}$ indicating the non-ravel seaming required at the start of sewing, and a stopping switch 72 generates a signal $V_{PT2}$ indicating the non-ravel seaming required at the end of sewing. The signals $V_{PT1}$ and $V_{PT2}$ are fed to the digital controller 3.

The digital controller 3 generates signals $V_R$, $V_U$ and $V_V$ which are fed to a reversing solenoid 101, a thread cutting solenoid 102, and a thread wiper solenoid 103, respectively. When the reversing solenoid 101 is energized, a work reversing mechanism (not shown) brings the work fabric back to the desired point and during that time the non-ravel seaming is done. The thread cutting solenoid 102 actuates a thread cutting mechanism (not shown) when it is energized. The thread wiper solenoid 103 actuates a thread wiper mechanism (not shown) when it is energized.

The more detailed description of the control circuit is given hereinafter. The speed signal $V_S$ from the speed signal generator 41 and the actual speed signal $V_{SA}$ from the tacho-generator 62 are fed to a speed controller 35. The speed controller 35 compares the actual speed signal $V_{SA}$ with the speed signal $V_S$ and produces signals $V_C$ and $V_B$ which are fed to the clutch coil 245 and the brake coil 244, respectively, so that the speed of the main shaft 11 is maintained at the speed proportional to the speed signal $V_S$. That is, when the actual speed signal $V_{SA}$ is smaller than the signal $V_S$, the clutch coil 245 is energized by the signal $V_C$. On the other hand, when the actual speed signal $V_{SA}$ is greater than the signal $V_S$, the brake coil 244 is energized by the signal $V_B$.

Further, a non-ravel seaming controller 31 is provided in the digital controller 3, to which the signal $V_{ST}$ from the start switch 42, the signal $V_{TO}$ from the thread cutting switch 43, the signals $V_{PT1}$ and $V_{PT2}$ from the non-ravel seaming switch 7 and the signal $V_p$ from the needle position detector 61 are fed. The non-ravel seaming controller 31 generates middle speed signals $V_{SM1}$ and $V_{SM2}$. A signal $V_R$ which is fed to the reversing solenoid 101, a signal $V_T$ which is fed to a needle position detecting circuit 37 and a thread cutting controller 38 is generated by the non-ravel seaming controller 31.

The description of the operation and the more detailed construction of non-ravel seaming controller 31 is given hereinafter.

The needle position detecting circuit 37 receives a signal $V_{SA1}$ from a low speed detector 36, the signal $V_p$ from the needle position detector 61, the signal $V_{ST}$ from the start switch 42 and the signal $V_T$ from the non-ravel seaming controller 31. The low speed detector 36 generates the signal $V_{SA1}$ when the signal $V_{SA}$ from the tacho-generator 62 decreases to a certain level. Upon receipt of the signal $V_{SA1}$, the needle position detecting circuit 37 generates a deceleration pattern signal $V_{SD}$ and applies this signal to the speed controller 35 so that the reciprocable needle 13 stops at the lowest position. The needle position detecting circuit 37 further generates a signal $V_N$ to the thread cutting controller 38 when the following signal $V_P$ is applied thereto during the signal $V_{SA1}$ from the lower speed detector 36. Consequently, the thread cutting controller 38 generates the signal $V_U$ to energize the thread cutting solenoid 102 and generates a signal $V_E$ to a thread wiper controller 39 when the signal $V_U$ is extinguished. Upon receipt of the signal $V_E$, the thread wiper controller 39 generates the signal $V_V$ to energize the thread wiper solenoid 103. When the signal $V_V$ is extinguished, the thread wiper controller 39 generates a clear signal $V_{CL}$ to the non-ravel seaming controller 31.

Figure 3:
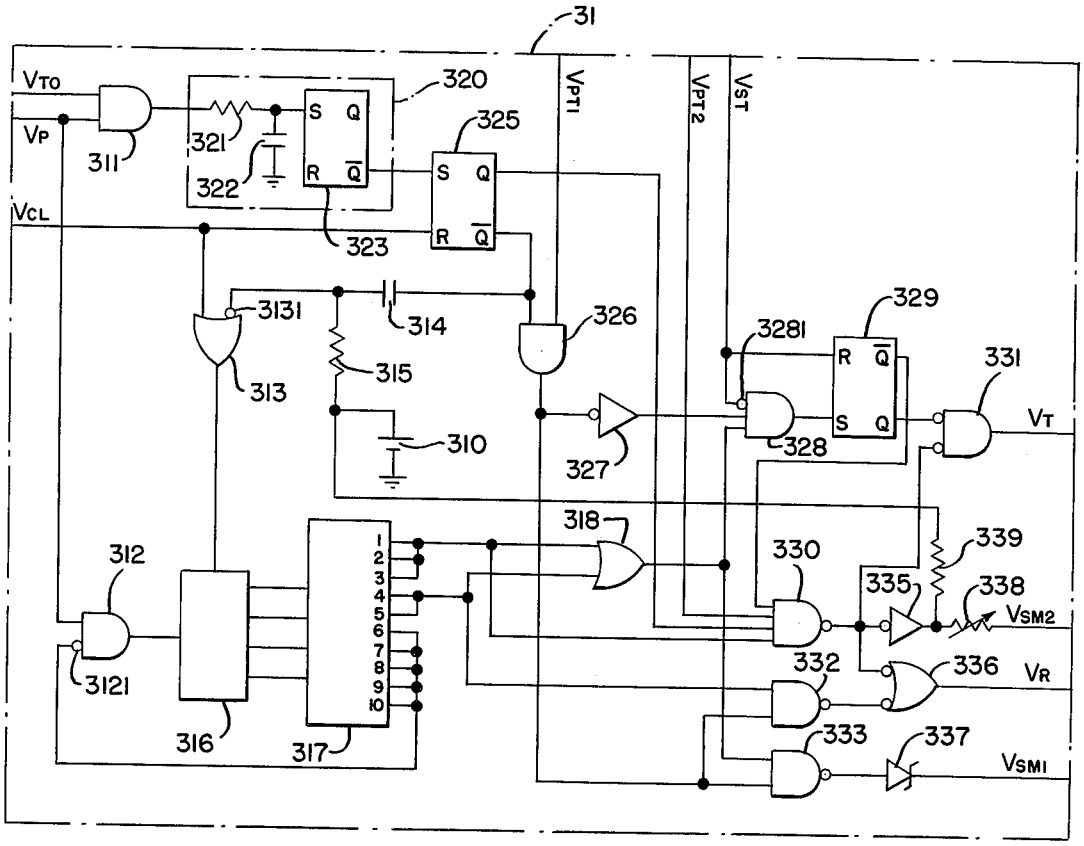
FIG. 3 is a schematic circuit diagram of a non-ravel seaming controller for the digital controller according to an embodiment of this invention.

Referring now to FIG. 3, there is shown the improved non-ravel seaming controller 31 of FIG. 2 in more detail. The signal $V_{TO}$ from the thread cutting switch 43 is fed to one input terminal of an AND gate 311 and the signal $V_p$ generated by the needle position detector 61 is fed to the other input terminal thereof. The output of the AND gate 311 is connected to the S input terminal of flip-flop 325 through a timing circuit 320, to an R input terminal of which the clear signal $V_{CL}$ from the thread wiper switch 39 is applied. The timing circuit 320 includes a flip-flop 323 having its $\overline{Q}$ output terminal connected to the S input terminal of the flip-flop 325, and a delay circuit consisting of a resistor 321 and a capacitor 322 which are inserted between the output of the AND gate 311 and the S input of the flip-flop 323. The Q output of the flip-flop 325 is connected to a third input terminal of a NAND gate 330, and the $\overline{Q}$ output thereof is connected to one input terminal of an AND gate 326.

An OR gate 313 has one input terminal to which the clear signal $V_{CL}$ from the thread wiper controller 39 is applied, and the other input terminal thereof is connected to the $\overline{Q}$ output of the flip-flop 325 through a capacitor 314 and an inverter 3131. A voltage source 310 is connected to the juncture between the capacitor 314 and the inverter 3131 through a resistor 315. The output terminal of the OR gate 313 is connected to the reset terminal of a binary four bit counter 316, to the input terminal of which the output of an AND gate 312 is connected.

Four output terminals of the binary counter 316 are connected to a decoder 317 which has ten output terminals T1 to T10. The AND gate 312 has one input terminal to which the signal $V_P$ from the needle position detector 61 is applied and the other input terminal connected to the output terminals T6 – T10 of the decoder 317 through an inverter 3121. The output terminals T1 – T3 of the decoder 317 are connected to one input terminal of an OR gate 318 and to a fourth input terminal of the NAND gate 330, and the output terminals T4 and T5 of the decoder 317 are connected to the other input terminal of the OR gate 318 and to one input terminal of a NAND gate 332. The output of the OR gate 318 is connected to a third input terminal of an AND gate 328 and to one input terminal of a NAND gate 333.

The signal $V_{PT1}$ from the starting switch 71 of the non-ravel seaming switch 7 is fed to the other input terminal of the AND gate 326, the output of which is connected to a second input terminal of the NAND gate 328 through an inverter 327 and to the other input terminals of the NAND gates 332 and 333. The signal $V_{PT2}$ from the stopping switch 72 of the non-ravel seaming switch 7 is fed to a second input terminal of the NAND gate 330. The signal $V_{ST}$ from the start switch 42 of the pedal sensor 4 is fed to a first input terminal of the AND gate 328 through an inverter 3281 and to the R input terminal of a flip-flop 329, the S input terminal of which is connected to receive the output of the AND gate 328. The $\overline{Q}$ output terminal of the flip-flop 329 is connected to a first input terminal of the NAND gate 330 and the Q output terminal thereof is connected to one input terminal of a NAND gate 331. The NAND gate 331, which has another input terminal connected to receive the output of the NAND gate 330, produces the signal $V_T$ at its output. The output of the NAND gate 330 is connected to the terminal of a variable resistor 338 through an inverter 335, at the other terminal of which the signal $V_{SM2}$ appears. The output terminal of the inverter 335 is connected to the voltage source 310 through a resistor 339. A NOR gate 336 which has two input terminals connected to receive the output of the NAND gates 330 and 332, respectively, produces the signal $V_R$ at its output. The NAND gate 333 produces the signal $V_{SM1}$ through a Zener diode 337.

The operation of the above-mentioned circuit is described with reference to FIG. 4. When the foot pedal 5 is depressed forward at time $T_0$ in FIG. 4, the start switch 42 of the foot pedal sensor 4 generates the start signal $V_{ST}$ and the speed signal generator 41 generates the speed signal $V_S$ proportional to the amount of the depression of the foot pedal 5. The rotating speed of the main shaft 11 of the sewing machine 1 increases according to the speed signal $V_S$ as shown in FIG. 4(a). At the same time, start signal $V_{ST}$ from the start switch 42 is fed to the first input terminal of the AND gate 328 through the inverter 3281 and to the R input terminal of the flip-flop 329 to reset the flip-flop. The "1" output at the $\overline{Q}$ output terminal of the flip-flop 329 is fed to the first input terminal of the NAND gate 330. The flip-flop 325, which was previously reset by the clear signal $V_{CL}$ from the thread wiper controller 39, generates a "1" output at its $\overline{Q}$ output terminal. When the signal $V_{PT1}$ from the starting switch 71 of the non-ravel seaming switch 7 is applied to the other input terminal of the AND gate 326, the "1" output appears at the output thereof. The "1" output of the AND gate 326 is fed to both of the input terminals of the NAND gate 332 and 333.

Figure 4:
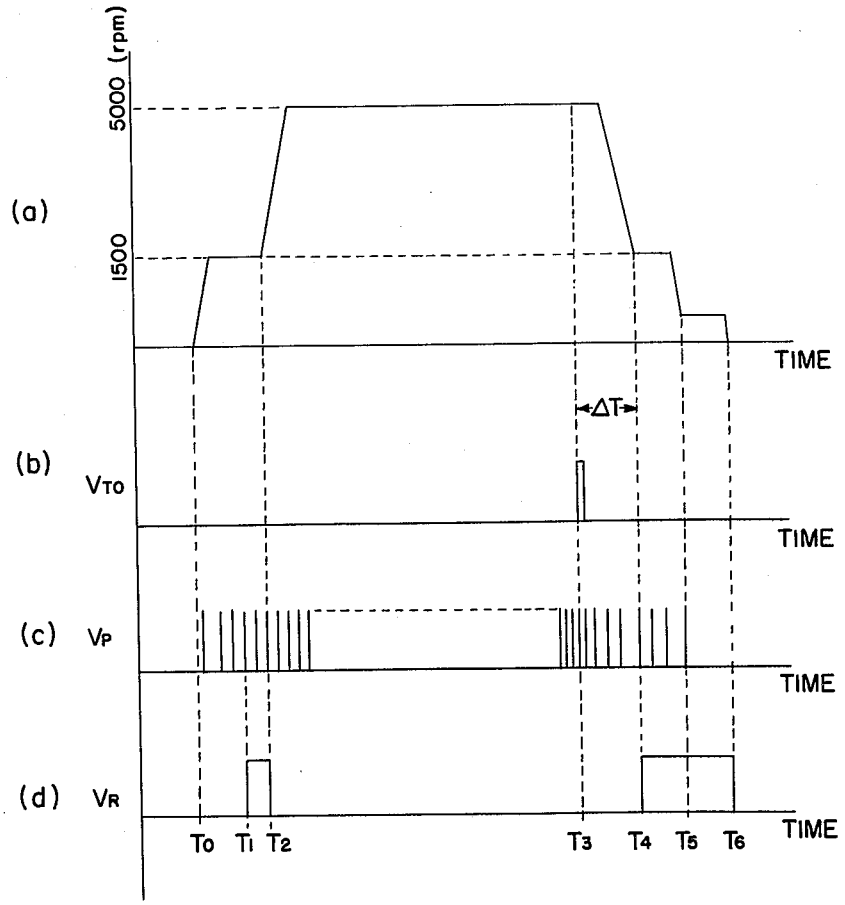
FIG. 4 shows the waveforms of the output signals from various portions of the circuit.

While the signal $V_P$ as shown in FIG. 4(*c*) from the needle position detector 61 is fed to the counter 316 through the AND gate 312, the AND gate 312 is opened because all the outputs of the decoder 317 are at the "0" level. The signal $V_P$ is counted by the binary counter 316. When the counted number is within the range of zero to three ($T_0$ to $T_1$), the OR gate 318 generates a "1" output at its output and the NAND gate 333 generates a "0" output. Therefore, the speed signal $V_S$, which is fed to the speed controller 35, is clamped under the level $V_{SM}$ by the Zener diode 337 so that the rotating speed of the main shaft 11 does not exceed a predetermined value, i.e., under 1500 rpm, during the non-ravel seaming operation ($T_0$ - $T_2$) as shown in FIG. 4(*a*). When the counted number of the signal $V_P$ is between four and five ($T_1$ to $T_2$), the NAND gate 332 generates a "0" output. Therefore, the NOR gate 336 generates the "1" output at its output terminal. The "1" output of the NOR gate 336 is fed to the reversing solenoid 101 as the signal $V_R$ as shown in FIG. 4(*d*) which actuates the work reversing mechanism.

When the counted number of the signal $V_P$ exceeds five (at $T_2$), the AND gate 312 is closed by the "1" output signals of the decoder 317 and the output of the OR gate 318 turns to the "0" level. The NAND gate 333 turns its output to the "1" level and the speed signal $V_S$ is fed to the speed controller 35. The rotating speed of the main shaft increases to high speed, i.e., up to 5000 rpm for example, according to the speed signal $V_S$ as shown in FIG. 4(*a*). At the same time the output of the NAND gate 332 turns to the "0" level when the counted number of the signal $V_P$ exceeds five (at $T_2$) and the signal $V_R$ generated at the output terminal of the NOR gate 336 turns to the "0" level as shown in FIG. 4(*d*). Therefore, the reversing solenoid 101 is deenergized.

After the non-ravel seaming operation at the start of sewing, the flip-flop 329 generates "1" output at its $\overline{Q}$ output terminal, which is fed to the first input terminal of the NAND gate 330. The stopping switch 72 of the non-ravel seaming switch 7 generates the "1" output at its output terminal as signal $V_{PT2}$ which is fed to the second input terminal of the NAND gate 330. When the foot pedal 5 is depressed backward (at $T_3$), the thread cutting switch 43 is actuated and the rotating speed of the clutch and brake motor is decreased. The signal $V_{TO}$ shown in FIG. 4(*b*) from the thread cutting switch 43 is fed to the thread cutting controller 38 and to the one input terminal of the AND gate 311. When the signals $V_P$ from the needle position detector 61 and the signal $V_{TO}$ are at the "1" level, and AND gate 311 generates the "1" output to the S input terminal of the flip-flop 325 through the timing circuit 320. The delay time of the timing circuit 320 is indicated by $\Delta T$ in FIG. 4(*b*). The flip-flop 325 is set and generates a "1" output at its Q output terminal which is fed to the third input terminal of the NAND gate 330. At the same time, the "0" output at the Q output terminal of the flip-flop 325 is fed to the other input terminal of the OR gate 313 through the capacitor 314 and the inverter 3131. The "1" output from the OR gate 313, therefore, is fed to the reset terminal of the binary counter 316. All the output terminals of the decoder 317 turn to the "0" level and the AND gate 312 is opened. The binary counter 316 begins to count the signal $V_P$ from the needle position detector 61. While the "0" output at the Q output terminal of the flip-flop 325 is fed to the one input terminal of the AND gate 326 and the output thereof turns to the "0" level. When the counted number of the signal $V_P$ is within the range of one to three ($T_4$ to $T_5$), the "1" output from the decoder 317 is fed to the fourth input terminal of the NAND gate 330. The NAND gate 330 generates a "0" output at its output terminal. Therefore, the NAND gate 331 which receives the "0" output from the NAND gate 330 and the "0" output from the Q output terminal of the flip-flop 329 generates at its output terminal the signal $V_T$ which inhibits the operation of the thread cutting controller 38. Meanwhile, the inverter 335 which receives the "0" output from the NAND gate 330 generates a "1" output. Therefore, the medium signal $V_{SM2}$ appears at the other terminal of the variable resistor 338. At the same time, the NOR gate 336 which receives the "0" output from the NAND gate 330 generates the $V_R$ signal to the reversing solenoid 101 to actuate the work reversing mechanism. When the counted number of the signal $V_P$ reaches four (at $T_5$), the outputs at the first to third output terminals of the decoder 317 turn to at the "0" level and the output at the fourth output terminal thereof turns to the "1" level. Therefore, the NAND gate 330 turns its output to the "1" level and the signal $V_{SM2}$ disappears. The rotating speed of the clutch and brake motor 2 is rapidly decreased once again. At the same time, the signal $V_T$ at the output terminal of the NAND gate 331 which inhibits the thread cutting operation is turned to "0" level and the thread cutting controller begins its operation upon receipt thereof. After the thread cutting operation and the thread wiping operation (at $T_6$), the clear signal $V_{CL}$ from the thread wiper controller 39 is fed to the R input terminal of the flip-flop 325 and to the one input terminal of the OR gate 313.

While we have shown and described one embodiment in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What is claimed is:

1. A control circuit for controlling the rotating speed of a clutch and brake motor of a sewing machine capable of performing non-ravel seaming at the start and the end of a sewing operation comprising start switch means for generating a start signal indicating the start of said sewing operation, first speed signal generator means for generating a signal representing the actual speed of said clutch and brake motor, needle position detector means for generating a needle position signal at each reciprocation of the needle, second speed signal generator means for generating a desired speed signal, operator controlled thread cutting switch means for generating a thread cutting signal, speed control means for controlling the speed of said clutch and brake motor by comparing the desired speed signal from said second speed signal generator means and the actual speed signal from said first speed signal generator means, and a non-ravel seaming controller which comprises first means for enabling said non-ravel seaming for a first predetermined duration subsequent to receipt of said start signal from said start switch means, and second means for generating a medium speed signal no greater than a predetermined level less than a normal speed at a predetermined time after the receipt of said thread cutting signal and applying said medium speed signal to said speed controller for controlling the speed of said clutch and brake motor in accordance therewith and for enabling said non-ravel seaming for a second predetermined duration at the end of said sewing operation.

2. A control circuit as claimed in claim 1, wherein said non-ravel seaming controller further comprises counting means for counting the needle position signals from said needle position detector means in order to control said first and second durations.

3. A control circuit as claimed in claim 2, wherein said counting means includes a binary counter, a decoder connected to the output of said binary counter and first gate means for applying said needle position signals to said binary counter, selected outputs of said decoder representing values above a predetermined count being connected to inhibit said first gate means.

4. A control circuit as claimed in claim 1, wherein said non-ravel seaming controller includes inhibiting means for inhibiting a thread cutting operation until at least completion of said non-ravel seaming for said second duration.

5. A control circuit as claimed in claim 3, wherein said second means includes third gate means responsive to said thread cutting signal and predetermined outputs of said decoder for generating said medium speed signal of said second means.

6. A control circuit as claimed in claim 2, wherein said first means clamps the speed signal from said second speed signal generator means to provide a medium speed signal at a value no greater than a predetermined level less than normal speed during said first duration.

7. A control circuit as claimed in claim 1, wherein said second speed signal generator means initiates a rapid decrease in the speed of said clutch and brake motor from said normal speed when said thread cutting switch means generates said thread cutting signal, said second means interrupting the rapid decrease in the speed of said clutch and brake motor by supplying said medium speed signal thereof to said speed control means for enabling said non-ravel seaming during said second duration.

8. A control circuit as claimed in claim 6 wherein said first means includes gate means responsive to said start signal and predetermined outputs of said counting means for generating a medium speed signal of said first means and clamping means connected to said gate means and said second speed signal generator means for limiting said desired speed signal to the value of the output of said gating means at the time said gating means generates an output.

9. A control circuit as claimed in claim 8 wherein said second means includes additional gate means responsive to said thread cutting signal and predetermined outputs of said counting means for generating said medium speed signal of said first means.

10. A control circuit as claimed in claim 9 wherein said second means further includes delay means for delaying application of said thread cutting signal to said additional gate means.

11. A control circuit as claimed in claim 5 wherein said second means includes delay means for delaying application of said thread cutting signal to said third gate means.

12. A control circuit as claimed in claim 11, wherein said first means clamps the speed signal from said second speed signal generator means to provide a medium speed signal at a value no greater than a predetermined level less than normal speed during said first duration.

13. A control circuit as claimed in claim 3, wherein said first means clamps the speed signal from said second speed signal generator means to provide a medium speed signal at a value no greater than a predetermined level less than normal speed during said first duration.

14. A control circuit as claimed in claim 13, wherein said first means includes second gate means responsive to said start signal and predetermined outputs of said decoder for generating a medium speed signal of said first means and a Zener diode connected to the output of said second gate means and the output of said second speed signal generator means to clamp said desired speed signal to the level of said medium speed signal of said first means.

15. A control circuit as claimed in claim 12, wherein said first means includes second gate means responsive to said start signal and predetermined outputs of said decoder for generating a medium speed signal of said first means and a Zener diode connected to the output of said second gate means and the output of said second speed signal generator means to clamp said desired speed signal to the level of said medium speed signal of said first means.

* * * * *